US012324491B2

(12) United States Patent
Christie

(10) Patent No.: US 12,324,491 B2
(45) Date of Patent: Jun. 10, 2025

(54) UNIVERSAL PACK-A-RELLA ANCHORING SUPPORT

(71) Applicant: Joseph Christie, Channelview, TX (US)

(72) Inventor: Joseph Christie, Channelview, TX (US)

( * ) Notice: Subject to any disclaimer, the term of this patent is extended or adjusted under 35 U.S.C. 154(b) by 0 days.

(21) Appl. No.: 17/234,758

(22) Filed: Apr. 19, 2021

(65) Prior Publication Data

US 2021/0401132 A1 Dec. 30, 2021

Related U.S. Application Data

(60) Provisional application No. 63/011,790, filed on Apr. 17, 2020.

(51) Int. Cl.

| | |
|---|---|
| ***A45F 3/04*** | (2006.01) |
| ***A45B 11/00*** | (2006.01) |
| ***A45C 13/40*** | (2006.01) |
| *A45F 3/00* | (2006.01) |

(52) U.S. Cl.

CPC ..... *A45B 11/00* (2013.01); *A45C 13/40* (2013.01); *A45F 3/04* (2013.01); *A45B 2200/109* (2013.01); *A45F 2003/003* (2013.01)

(58) Field of Classification Search

CPC ..... A45F 2003/003; A45C 13/40; A45B 3/10; A45B 11/02

USPC ..... 224/186; 135/16

See application file for complete search history.

(56) References Cited

U.S. PATENT DOCUMENTS

| | | | | | |
|---|---|---|---|---|---|
| 903,682 | A * | 11/1908 | Cumpston | A45B 11/02 | 224/629 |
| 1,704,407 | A * | 3/1929 | Rice | A45B 11/02 | 224/0.5 |
| 2,541,614 | A * | 2/1951 | Rosenberger | A45B 11/00 | 224/188 |
| 3,120,332 | A * | 2/1964 | White | A45B 11/02 | 224/189 |
| 3,554,203 | A * | 1/1971 | Hall, Sr. | A45B 11/02 | 135/16 |
| 5,082,235 | A * | 1/1992 | Crowther | G06F 1/1611 | 248/447.2 |
| 6,308,722 | B1 * | 10/2001 | Christie | A45B 11/00 | 224/186 |
| D714,540 | S * | 10/2014 | Barlet | D3/215 | |
| 8,881,961 | B1 * | 11/2014 | Cibirka | A45F 5/00 | 224/604 |
| 2008/0078790 | A1 * | 4/2008 | Bolling | A45C 13/40 | 224/190 |
| 2013/0213445 | A1 * | 8/2013 | Christie | A45C 13/40 | 135/16 |
| 2014/0158725 | A1 * | 6/2014 | Christie | A45C 13/04 | 224/186 |

FOREIGN PATENT DOCUMENTS

| | | | | |
|---|---|---|---|---|
| GB | 2214802 A * | 9/1989 | ..... | A45B 11/02 |

* cited by examiner

*Primary Examiner* — Scott T McNurlen

(74) *Attorney, Agent, or Firm* — Delphine James

(57) ABSTRACT

The present invention comprises a backpack with an anchoring device. The anchoring device allows an umbrella to be attached to the backpack or bags. The umbrella has a collapsible canopy and can be stored in a storage unit within on the backpack or carrier bag.

9 Claims, 2 Drawing Sheets outer tube pushed down to release

UNIVERSAL PACK-A-RELLA ANCHORING SUPPORT

BACKGROUND OF THE INVENTION

This invention relates to a universal anchoring device for an umbrella, more specifically the anchoring device can be supported by any carrier bag, to include carrier bag or backpack, or any bag with a shoulder strap.

Umbrellas intended for hand-held use are generally comprised of a collapsible canopy, an elongated shaft that is usually telescopically extendable, and a holding handle disposed at the lower extremity of the shaft. Such umbrellas have long been used by persons desiring to shield themselves from the sun, rain and the harmful elements. It is well established that, from a health standpoint, it is desirable to minimize exposure to direct sunlight.

Conventionally, umbrellas are hand carried by the person using the umbrella. Carrying an umbrella, however does not allow the free use of a person's hands to carry packages or the like, or perform other functions. It is therefore desirable to provide an improved umbrella that will allow a person using the umbrella to use their hands without being encumbered by the umbrella.

While umbrellas have heretofore been strapped to the back of a person, they are difficult to attach, and the harnesses are clumsy. Further, such harnesses must be detached if the umbrella is to be hand-held, as is conventional. It is therefore desirable to provide an umbrella which can be worn, if desired, but which includes structure which allows the umbrella to be worn or hand-held, as desired, while still being convenient to use and conveniently stored. In addition, this Stabilizing Unit maybe used to secure the umbrella, not only to the back of the user, but also to the users side.

Examples of such back-mounted umbrellas are disclosed in U.S. Pat. Nos. D330,455; D345,856; D361,654; U.S. Pat. Nos. 3,892,251 and 4,188,965. In general, such back-mounted umbrellas involve a harness which either secures an umbrella of usual construction having a bottom handle, or secures a specially constructed umbrella having a straight shaft that removably inserts into a holding structure associated with the harness.

A common shortcoming of prior back-mounted umbrellas is that the umbrella tends to rotate within the holding structure, particularly in strong winds. Also, tilting movements in both the path of the person's walking movement and in the lateral or transverse direction are difficult to control. When a specialized harness is employed, it is difficult to emplace and is restrictive, and serves no other useful purpose.

It is accordingly an object of the present invention to provide an umbrella and frame support combination wherein the stabilizing unit provides support for the umbrella.

It is a further object of this invention to provide the combination of the foregoing object wherein the umbrella is easily attached to and removed from a receiver attached to the stabilizing nit support.

It is another object of the present invention to provide the combination of the aforesaid nature wherein the umbrella, in its deployed, open state is stabilized with respect to rotating and tilting movements. A strap at the bottom of the backpack or bag can add additional security.

It is yet another object of this invention to provide the combination of the aforesaid nature wherein said carrier bag contains means for securing said umbrella in its collapsed, storage state.

It is a still further object of the present invention to provide the combination of the aforesaid nature wherein the separate functionality of umbrella and bag remains unimpaired.

It is farther object of the invention to provide a universal stabilizing unit to adhere to any size bag or backpack to include Small, Medium and Large units or Kids, Women, and Men sizes.

These objects and other objects and advantages of the invention will be apparent from the following description.

SUMMARY OF THE INVENTION

The above and other beneficial objects and advantages are accomplished in accordance with the present invention by an umbrella and a universal stabilizing unit anchoring device to be used in combination with any type of carrier bag, or backpack combination comprising: a) an umbrella comprising a collapsible canopy and a straight center shaft interactive with said canopy and extending to a lower handle having a fastener releasably engaged within the tubular receiver mounted within an anchoring structure; b) a carrier bag or backpack having a storage compartment bounded in part by a bottom panel with adjoining sidewalls extending upward to an enclosure opening with attached shoulder straps, and c) The embodiment further comprises an anchoring structure which is removable from the storage compartment of the carrier bag. d) the anchoring structure is adjustable in length and width to accommodate the interior cavity of any carrier bag.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
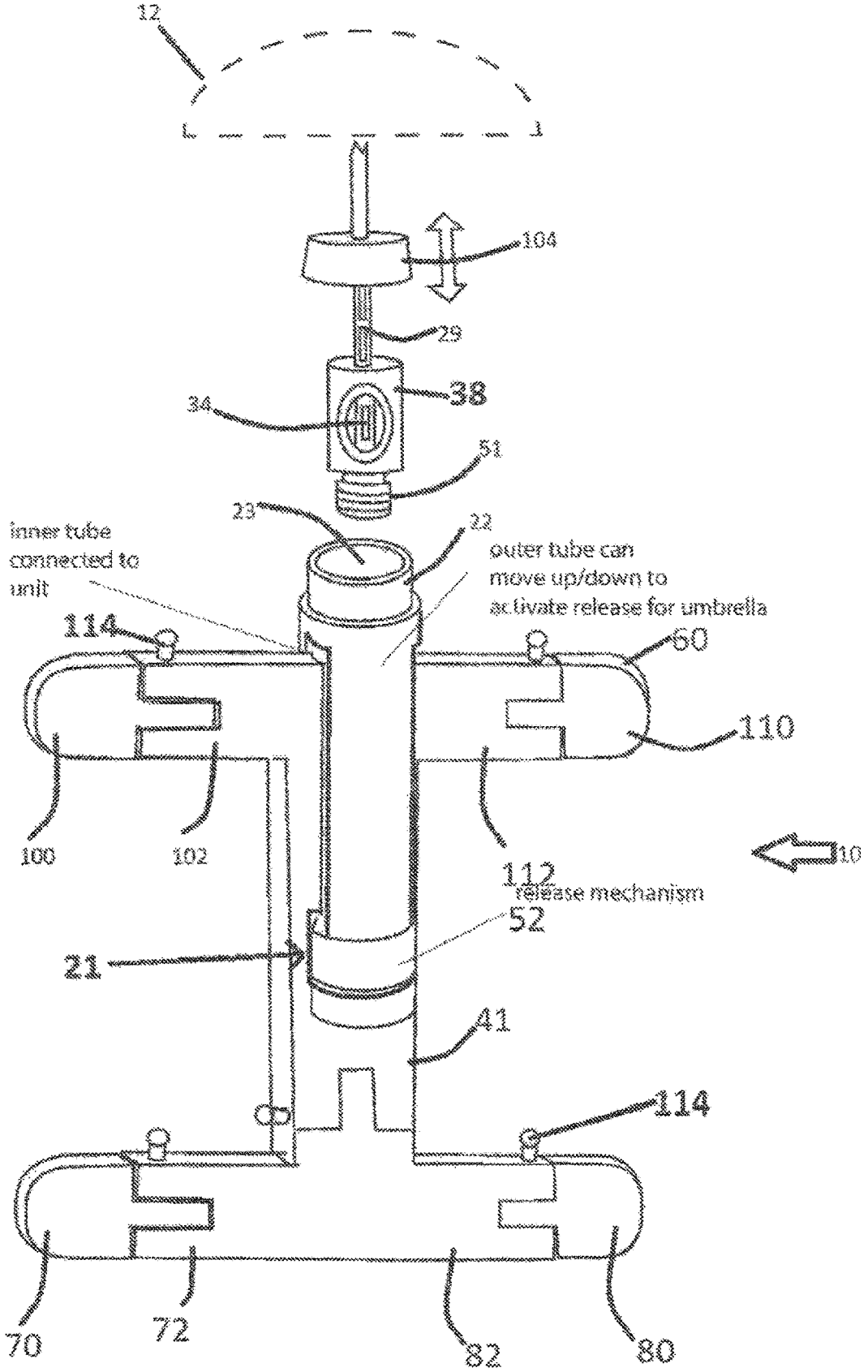
FIG. 1 is a front perspective view of the present invention.

Referring now to FIGS. 1-5, an embodiment of the umbrella and frame support combination (10) of the present invention is shown comprised of frame structure (10) and umbrella (12) with adjustable shaft (29). In FIGS. 1-5 there is shown a frame structure (10) that can be inserted into the interior cavity of any carrier bag. Frame structure (10) comprises anchor structure (21), top panel (60) and bottom panel (65).

The top panel (60) and bottom panel (65) horizontally extends the width of the interior cavity of the bag while the vertical panel member (41) vertically extends the height of the interior cavity of the carrier bag (not shown). In use, the frame structure (10) is inserted through the opening of bag and abuts the bottom of the interior cavity of the bag (not shown).

Referring FIGS. 1-5, umbrella stabilizing unit holding mechanism in the form of anchoring structure (21). Anchoring structure (21) further includes a vertically disposed tubular receiver (22) having an open upper extremity (23) and a closed lower portion (42). Within the lower portion (42) is a female fastener (52) for receiving the male fastener (51) attached to the lower end of the umbrella shaft (29). In the preferred embodiment, to stabilize the umbrella (12), the anchor structure 21 is fixably mounted within tubular receiver (22) disposed between the top panel (60) and bottom panel (65).

Figure 2:
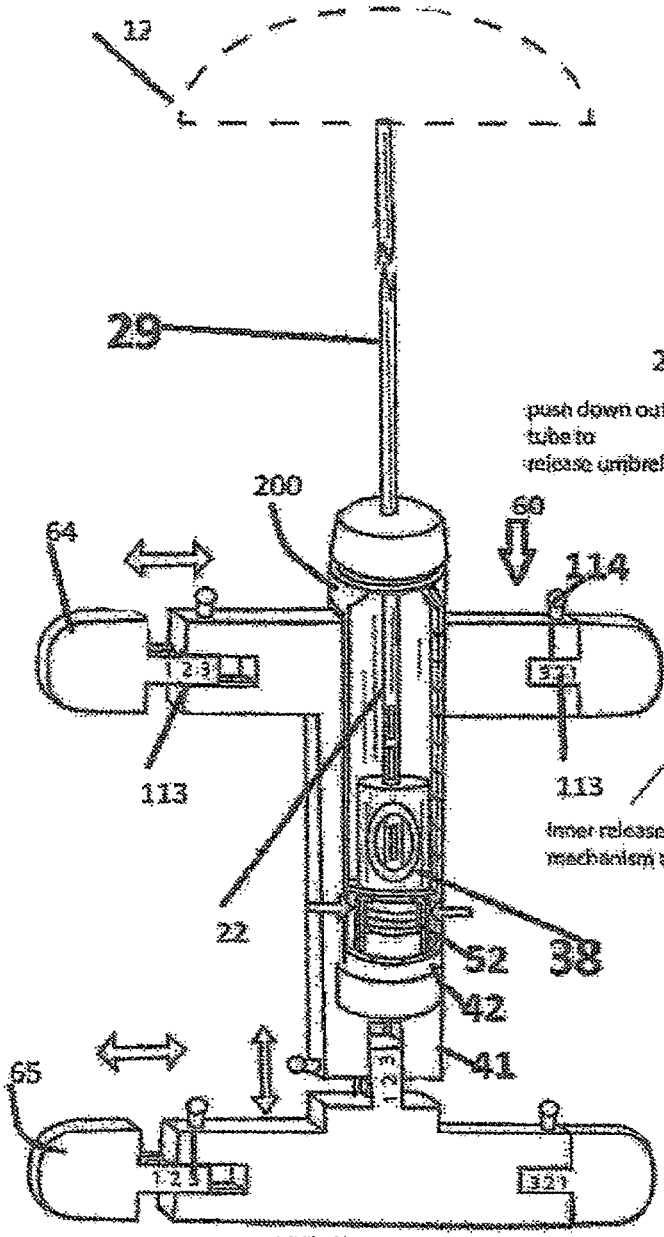
FIG. 2 is a front cross view of the anchor device.

As shown in FIG. 2, the anchoring structure (21) is vertically mounted within the front panel (60) and back panel (65). This allows the stabilizing unit (10) to be placed in a conventional carrier bag. Anchoring structure (21) may be fabricated of lightweight metal such as aluminum, or may be fabricated of plastic, in which case it may be a monolithic structure produced by way of a molding operation.

Umbrella shaft (29), preferably of telescopically extendable tubular construction, extends to a lower terminal handle equipped with male fastener (51) that interlocks into the female fastener (52) located within the lower compartment (42) of tubular receiver (22) disposed above vertical panel (41).

As shown in FIG. 1-5, locking mechanism comprises female fastener 52 and male fastener 51. In one embodiment, mating male fastener 51 can be fabricated as a locking pin which securely engages within female connector member (52) located within lower compartment (42) of the tubular receiver (22. Alternatively, locking mechanism can be manufactured by way of other suitable means.

A push-button control 34 on shaft 29 causes the canopy of the umbrella (12) to move vertically upward or downward. The umbrella, in its collapsed storage state may have a length of between about 10 and 14 inches.

When shaft (29) is inserted into open extremity (23) of tubular receiver (22) and the user pushes downward, the umbrella is sufficiently secure so as to resist any movement about the axis of shaft (29), and to resist tilting movement in any direction away from the vertically secured position within tubular receiver (22). A hand grip (38) is preferably associated with shaft (29) adjacent the terminal extremity of shaft (12). Hand grip (38) facilitates the use of the umbrella in a conventional hand-held manner detached from anchoring structure (21). Cap (104) secures shaft (29) within tubular receiver (22).

The anchoring structure (21) comprises opened tubular member (22) centrally and fixably mounted between adjustable top (60) and bottom (65) panels. At the top end of the top panel (60) are opposing telescoping upper bar members. At the lower end of the tubular member (22) is opposing telescoping lower bar members. The vertical shaft member (41) can extend to the longitudinal length of the interior cavity of the carrier bag (not shown). The upper and lower bar members can extend asynchronously to the upper and lower width of the internal cavity of the carrier bag.

Anchor (2) further comprises a centrally located tubular member (22) defined by an upper hollow tubular member with a closed connector compartment (42) located above the bottom panel (65). The lower end of the umbrella shaft (29) have a male attachment (51) that engages within the female attachment (52) within the connector member compartment located within lower portion (42) of tubular receiver (22).

A grip member (38) surrounds the lower end of the umbrella shaft (29) leaving an opening over the push button pin (34) which opens the umbrella canopy. The upper portion of tubular receiver (22) is fixably attached between the top and bottom panels. A sleeve (200) circumferentially encapsulates the upper portion of tubular receiver (22) and extends linearly downward terminating upon the outer perimeter of compartment 42. When the sleeve (200) is depressed, the male attachment (51) is released from the female attachment (52) from within the chamber located within the lower end (42) of tubular receiver (22).

Figure 3:
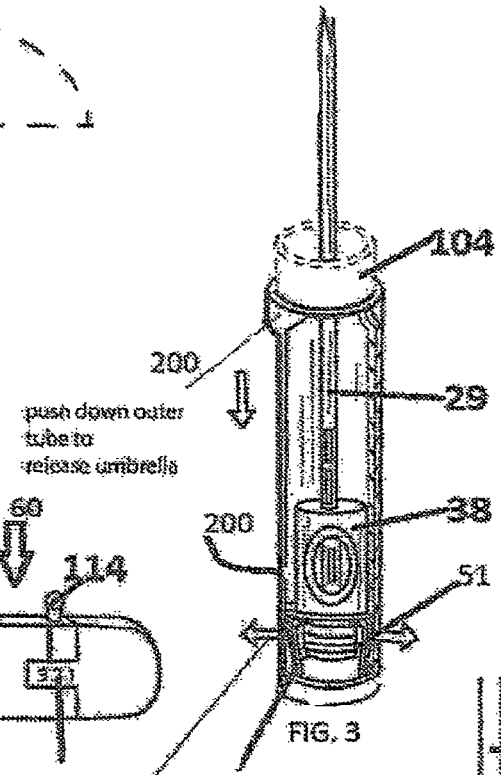
FIG. 3 is a cutaway view of the tubular receiver.
Figure 4:
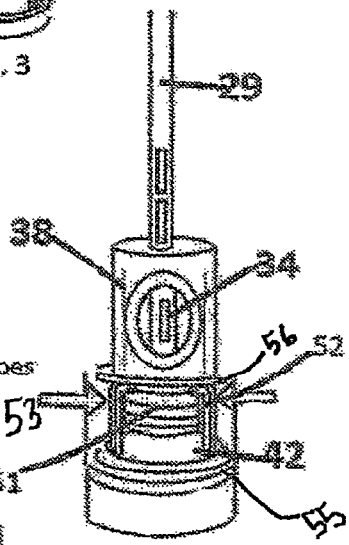
FIG. 4 is a cutaway view of the tubular receiver.
Figure 5:
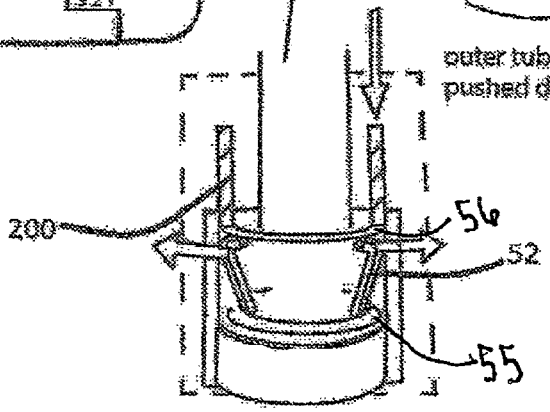
FIG. 5 is a cutaway view of the tubular receiver.

Depicted in FIGS. 3,4 and is the locking mechanism or [fe]male attachment (51) that holds the handle within the lower compartment (42). As depicted the connection member (53) is disposed above the spring member (55) within lower compartment (42). Attaching elements (52) are internally and circumferentially mounted about the connection member (53). In use, to engage the male attachment [plug] (51) is pushed downward into the connection member and engages with the attaching elements (52). To disengage, as the [fe]male attachment (51), sleeve (200) is pushed downward upon the annular ring (56) of the connection member (53) the flexible attaching elements (52) move outwardly against the force of spring member (55) thereby releasing the male attachment (51).

A pair of upper telescoping arms is formed within the top panel (60) and a pair of lower telescoping arms is formed within bottom panel (65). The pair of upper telescoping arms adjusts the length of the top panel (60) and the pair of lower telescoping arms adjusts the length of the bottom panel (65). The lower vertical telescoping member (41) adjusts the length of the tubular receiver (22) along the longitudinal axis of the central column. The telescoping arms adjust horizontally or vertically and asynchronously to the width or length of the interior of the carrier bag or backpack. Top panel (60) and bottom panel (65) each have adjustable telescoping arms with same length and symmetrical shape. Each telescoping arm of the top (60) and bottom panel (65) has a left section and a right section. Each left and right section of top panel (60) is further defined by an inner portion (102, 112) and an outer portion (100, 110). Each left and right section of bottom panel (65) is further defined by an inner portion (72, 82) and an outer portion (70, 80).

Each outer portion (100, 110) has a guide rail with a plurality of adjustment holes that extends outward forming a T shape. Each inner portion (102, 112) is fixably attached to the tubular receiver with a recessed portion to operationally receive the guide rail. The top panel (60) is horizontally disposed below the top opening of the tubular receiver (22) while the bottom panel (65) is horizontally disposed below the vertical adjustable panel (41).

Bottom section (82) is operationally configured with guiding rails that form a T-shape. Top section (82) is fixably attached to the lower end (42) of tubular receiver (22) with a recessed channel that is operationally configured to receive the guiding rail in bottom section (82). Each guiding rail has a plurality of adjustment holes wherein each hole represents an adjustable length. To adjust the length of each lock pin (114), it is securely engaged within one of the pluralities of adjustment holes located within the guiding rails.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. An anchor support structure in combination with an umbrella, the structure comprising:

a top horizontal panel and a bottom horizontal panel with a vertical column disposed and incorporated there between;

the top horizontal panel, the bottom horizontal panel, and the vertical column extending to a predetermined length dimensioned for supporting an interior cavity of a carrier bag;

the umbrella having a shaft extending downwardly to a terminal end with a locking mechanism operationally incorporated thereon;

a tubular member incorporated within an upper portion of the vertical column;

the tubular member extending to a distal end forming a lower compartment that houses a mating locking mechanism;

the bottom horizontal panel and the [vertical column] top horizontal panel within the same plane;

the top horizontal panel and the bottom horizontal panel in a parallel arrangement and perpendicularly aligned at a median point with the vertical column;

a vertical panel integrated within a lower portion of the vertical column beneath the lower compartment;

the vertical panel is in the same plane as the bottom horizontal panel; and the tubular member having a bore dimensioned to receive the shaft; the locking mechanism of the handle being operationally coupled to the mating locking mechanism within the lower compartment.

2. The structure of claim 1 wherein the bottom horizontal panel further comprises:

a left side disposed on the left side of the vertical column;

and a right side disposed on the right side of the vertical column.

3. The structure of claim 2 wherein the left side of the bottom horizontal panel further comprising a telescoping mechanism incorporated therein for asynchronously adjusting length therewith.

4. The structure of claim 2 wherein the right side of the [vertical] bottom panel further comprising a telescoping mechanism incorporated therein for asynchronously adjusting length therewith.

5. The structure of claim 1 wherein the top panel further comprises:

a left side disposed on the left side of the vertical column;

and a right side disposed on the right side of the vertical column.

6. The structure of claim 5 wherein the left side of the top horizontal panel further comprising a telescoping mechanism incorporated therein for asynchronously adjusting length therewith.

7. The structure of claim 5 wherein the right side of the top horizontal panel further comprising a telescoping mechanism incorporated therein for asynchronously adjusting length therewith.

8. The structure of claim 1 wherein the vertical panel further comprises a telescoping mechanism for adjusting the length therewith.

9. An anchor support structure in combination with an umbrella, the structure comprising:

a top horizontal panel and a bottom horizontal panel with a vertical column disposed and incorporated there between;

the top horizontal panel, the bottom horizontal panel, and the vertical column extending to a predetermined length dimensioned for supporting an interior cavity of a carrier bag;

the umbrella having a shaft extending downwardly to a terminal end with a locking mechanism operationally incorporated thereon;

a tubular member incorporated within an upper portion of the vertical column;

the tubular member extending to a distal end forming a lower compartment that houses a mating locking mechanism;

the bottom horizontal panel and the top horizontal panel within the same plane;

the top horizontal panel and the bottom horizontal panel in a parallel arrangement and perpendicularly aligned at a median point with the vertical column;

a vertical panel integrated within a lower portion of the vertical column beneath the lower compartment;

the vertical panel further comprises a telescoping mechanism for adjusting the length therewith; and the tubular member having a bore dimensioned to receive the shaft; the locking mechanism of the handle being operationally coupled to the mating locking mechanism within the lower compartment.

* * * * *